United States Patent [19]

Peterson

[11] Patent Number: 4,561,658

[45] Date of Patent: Dec. 31, 1985

[54] MATH MATCHING GAME

[76] Inventor: Amy L. Peterson, Rte. 2, Box 85, Clinton, N.C. 28328

[21] Appl. No.: 688,163

[22] Filed: Dec. 31, 1984

[51] Int. Cl.[4] ..... A63F 3/00

[52] U.S. Cl. ..... 273/243; 434/348

[58] Field of Search ..... 273/243, 287, 244, 248, 273/249; 434/348, 347, 327

[56] References Cited

U.S. PATENT DOCUMENTS

| | | | |
|---|---|---|---|
| 2,871,581 | 2/1959 | Cuzak | 434/209 X |
| 2,899,756 | 8/1959 | Wise | 434/208 |
| 2,902,775 | 9/1959 | Arrowsmith et al. | 434/348 |
| 3,371,931 | 3/1968 | Saunders | 273/249 |
| 3,394,471 | 7/1968 | Holten | 273/284 X |
| 3,817,531 | 6/1974 | King et al. | 273/243 |
| 3,928,922 | 12/1975 | Rosenbaum | 434/322 |
| 4,109,918 | 8/1978 | Mele et al. | 273/256 |
| 4,378,941 | 4/1983 | Derby | 273/273 |

*Primary Examiner*—Richard C. Pinkham
*Assistant Examiner*—Scott L. Brown
*Attorney, Agent, or Firm*—Mills and Coats

[57] ABSTRACT

The present invention entails a matching game and game board therefor for teaching math fundamentals such as multiplication, addition, subtraction, etc., to children. Cards having math problems thereon are distributed about the game board and during the course of the game individual players, via tokens, advance over the cards and around the game board. At the conclusion of each advancement, the particular card that the player lands on is presented as a mathematical problem. An answer is given by a player for that particular problem and the correctness of the answer is checked by a matching answer area formed on the game board itself. According to game rules, a correct answer is appropriately rewarded.

11 Claims, 2 Drawing Figures

MATH MATCHING GAME

FIELD OF INVENTION

The present invention relates to games and game boards, and more particularly to games and game boards relating to teaching math fundamentals to children, and even more particularly to a math matching game and game board that teaches math fundamentals through a matching process.

BACKGROUND OF INVENTION

Most parents are well aware of the difficulties presented in teaching their children certain math fundamentals such as the basic multiplication tables. Such can be time consuming and even sometimes frustrating because of the relatively short attention span some children possess and further because effective teaching of multiplication and other math fundamentals often requires repetitive drilling exercises.

Thus, there is a need for a teaching approach to math fundamentals that get children involved and holds their attention, and which is effective in actually teaching fundamentals.

SUMMARY AND OBJECTS OF INVENTION

The present invention entails a game and game board that is designed to teach children math fundamentals such as multiplication, addition, subtraction, etc.

The present invention entails a game and game board that is provided with a series of cards. Each card includes a math problem thereon. During the course of the game, individual players advance around the game board and over the respective math problem cards. At the conclusion of each advancement, the math problem card "landed on" is presented for answer. A player, according to game rules, states an answer. The stated answer is checked by an answering area formed on the game board, and according to game rules a player is either rewarded or penalized according to the correctness of his or her answer.

Therefore, it is appreciated that in playing the game and attempting to pursue the ultimate objective of the game that the individual children playing the same are constantly drilled in certain math fundamentals which has the effect of teaching such math fundamentals to the individual children playing the game.

It is, therefore, an object of the present invention to provide a game and game board apparatus for effectively teaching math fundamentals such as multiplication, addition, subtraction, etc.

Another object of the present invention resides in the provision of a game and game board for teaching math fundamentals that is designed to be interesting, exciting and which will hold the attention of the individuals participating.

A further object of the present invention resides in the provision of a math teaching game and game board that is versatile inasmuch as the same can be used to teach various math fundamentals such as multiplication, addition, subtraction, etc.

It is also an object of the present invention to provide a math game and game board that is not complex but which is easy to understand and play and is especially adapted for use by young children for learning certain math fundamentals.

Still a further object of the present invention resides in the provision of a game and game board designed for teaching children math fundamentals which inherently exposes the children playing the game to repetitious drilling which enhances the learning of math fundamentals in such a way that these fundamentals are retained by the individuals and are not easily forgotten.

Another object of the present invention resides in the provision of a math teaching game and game board of the character referred to above that is designed to teach math fundamentals such as multiplication, addition and subtraction through a game process wherein the individual children playing the game are attempting to accomplish the basic game goals and objectives and are learning certain math fundamentals in the process as they are an integral part of the game and are so structured and integrated into the game such that the children can only win or favorably perform the game by mastering these math fundamentals.

Other objects and advantages of the present invention will become apparent from a study of the following description and the accompanying drawings which are merely illustrative of such invention.

DETAILED DESCRIPTION OF INVENTION

Figure 2:
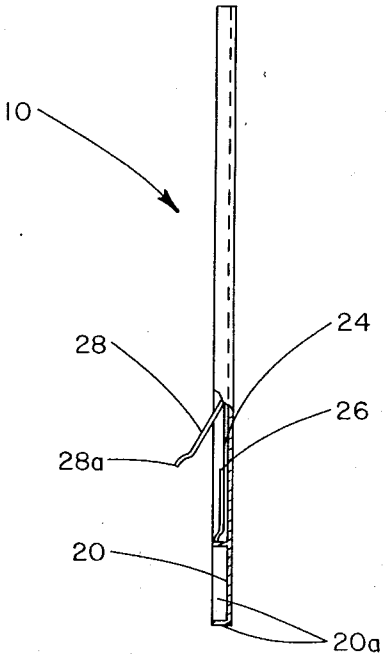
FIG. 2 is a side elevational view of the game and game board apparatus of the present invention, again with portions broken away to better illustrate the total structure of the game and game board apparatus.

With further reference to the drawings, the game and game board apparatus of the present invention is shown therein. As seen the present invention entails a game board apparatus that is indicated generally by the numeral 10.

Forming a part of the present game and game board apparatus is a series of math problem cards 12. Each math problem card 12 includes a math problem printed thereon. In the present disclosure, the game and game board apparatus of the present invention is designed to teach basic multiplication tables. It is understood, however, that the game and game board apparatus of the present invention could be used in the same manner as hereinafter described to teach other basic math fundamentals such as addition, subtraction, etc. Continuing to refer to the present disclosure and the present invention as disclosed herein, it is noted that each math problem or card 12 includes a multiplication problem thereon. For example as shown in the drawing, the top math problem card 12 of the two stacks shown includes the problem $6\times9$ and $8\times5$. In the case of the present game and game board apparatus, the multiplication tables involved entail all of the possible even number problems that yield answers up to the answer "81". This obviously takes care of all of the even number multiplication problems involving the numbers 1 through 9.

In addition forming a part of the game and game board apparatus of the present invention is a series of coins or reward means 14. The significance of these will be more fully appreciated from subsequent portions of this disclosure and especially in the area of this disclosure that deals with how the present game is played.

Also the game and game board apparatus of the present invention includes a series of tokens 16 that during the course of playing the present game are moved in increments about the game board 10 in accordance with the rules of the present game. In order to establish movement values for the respective tokens 16, there is provided chance means in the form of two dice 18.

Turning now to a discussion of the game board 10, it is seen that the game board disclosed herein is of a generally square configuration and it is appreciated that the same could be constructed of any suitable material such as a relatively stiff hard board, plastic or the like.

Formed about the upper side of the game board 10 about the periphery thereof is a series of receiving areas 20. The receiving areas 20 are specifically designed to receive in face down fashion the respective math problem cards 12. Each receiving area includes a surrounding wall 20*a* that defines the area for receiving one or more of said math problem cards 12. Surrounding wall 20*a* acts to confine the cards within the respective receiving area 20 during the course of the game. Formed about the outer portion of surrounding wall 20*a* is a thumb indention 20*b* that enables a player to lift and retrieve one math problem card 12 at a time from any receiving area 20 formed about game board 10.

Formed interiorly of the loop of receiving areas 20 is an answer matching area indicated generally by the numeral 22. The answer matching area 22 comprises a lower matching problem area or board 24. This problem area or board 24 includes math problems that correspond to the math problems found on the respective math problem cards 12. Again the math problems are inscribed or printed on the matching problem area or board 24.

Figure 1:
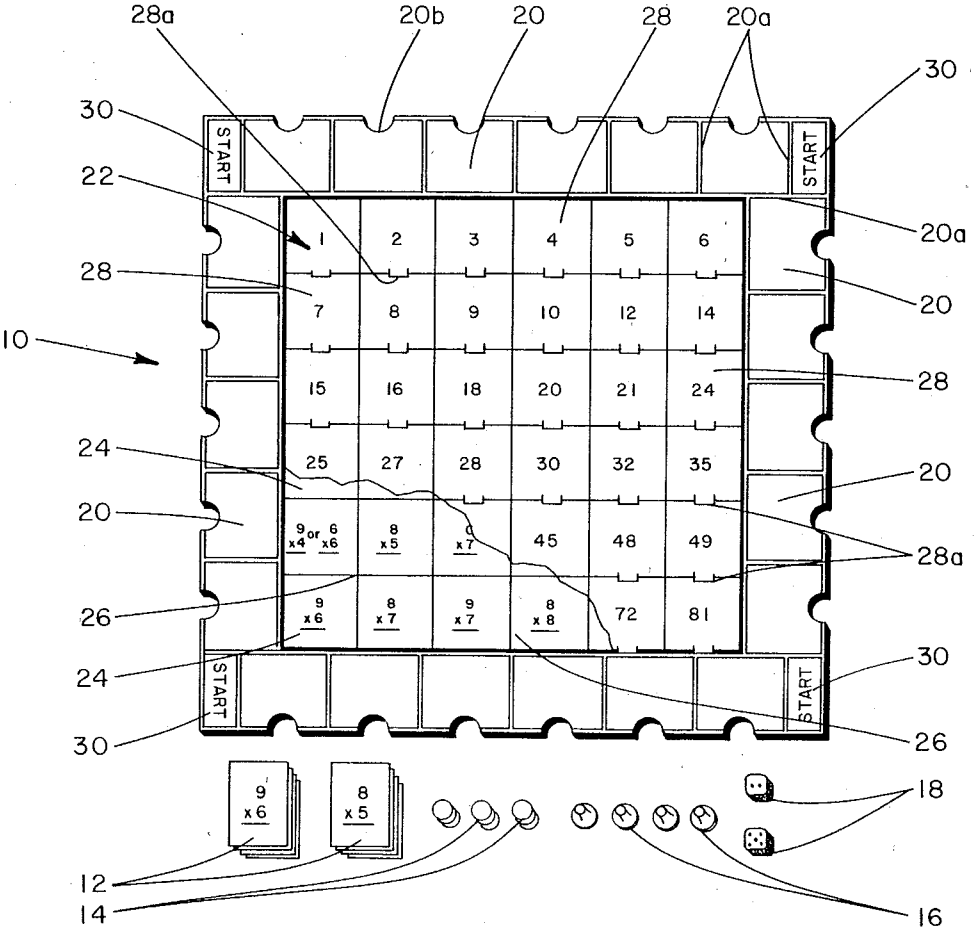
FIG. 1 is a plan view of the game and game board apparatus of the present invention and illustrates the various components comprising the game and game board apparatus and wherein portions of the game board are broken away to illustrate underlying structure.

An open frame structure is disposed over the problem board 24 and effectively divides the problem board 24 into equal areas. In each area defined by the open frame structure 26, there is provided therein one or more math problems for a given answer. For example, it is seen in FIG. 1 that one of the defined areas includes two math multiplication problems, one being $9\times4$ and the other being $6\times6$. In this case it is seen that both of the problems yield a correct answer of "36".

Secured to the open frame structure 26 is a series of answer flaps 28. There is provided an answer flap for each possible answer to the multiplication problems provided.

Each answer flap 28 includes an answer inscribed or printed on the upper side thereof. The game board is designed such that underneath each answer flap 28 there is one or more multiplication problems that match the problems presented and found on the math problem cards 12. In each case the answer to each of the multiplication problems found underneath the respective answer flaps 28 is the answer found on the top of the answer flap itself. For example, in the case of the present disclosure, for the answer flap having the answer "24", one would find thereunder two multiplication problems, one being $3\times8$ and the other being $4\times6$.

It is seen that each answer flap 28 is pivotably connected to the open frame structure 26 and is movable from a closed position that directly overlies the underlying matching math problems to an open inclined position, FIG. 2, which enables one to visually see the underlying matching multiplication problems. Further, it is seen that each answer flap 28 includes a lift tab 28*a* that enables the respective answer flap 28 to be easily and conveniently moved from their closed position to an open position.

Finally the game board 10 includes four "start" areas 30 with each start area 30 formed about one corner of the game board.

In playing the present game, it is appreciated that from two to four players can participate. To prepare the game for playing, the respective math problem cards 12 are laid face down onto the respective receiving areas 20. To do this the math problem cards 12 are placed one at a time onto each respective receiving area 20 in a continuous fashion until all of the math problem cards have been distributed.

Next a banker is appointed and the banker distributes to each player a selected number of coins 14. It is contemplated that an appropriate number of coins to be distributed at the start of the game would be ten.

Then each player places his or her playing token 16 on a respective start area 30. To determine which player starts the game first, the dice 18 is rolled and the player with the highest number is designated to start the game. After that the next player to play will be the player to the left of the first player and then each succeeding player will be that player to the left of the preceding player.

To carry forth with the game, each player will in turn roll the dice 18. Once the dice has been rolled, each player will advance his or her playing token 16 through a number of receiving areas 20 corresponding to the value of the dice 18. Once the player has advanced his or her token through an appropriate number of increments, the player will then pick up the top math problem card 12 disposed on the receiving area 20 in which he or she lands.

The player then views that respective math problem card 12 and attempts to answer the problem presented thereby. Once the player states his answer, he or she then lifts the answer flap 28 having that answer thereon. Once the answer flap is raised to its open position, the players will observe the problem or problems underlying the answer flap to determine if any one of the underlying problems match the problem of the particular math problem card being the subject of the present exercise. If there is a match, it follows that the answer given by the player was correct. If there is no match, it follows that the answer was incorrect. If the answer was correct, then the player is rewarded by a coin 14 from the bank and at the same time the banker takes that particular math problem card 12 and discards the same into the bank.

If per chance the given answer is incorrect, the present game rules contemplate that the player giving the wrong answer may challenge another player to answer the same problem. If the challenged player answers correctly, the player making the challenge is required to transfer one coin to the player responding correctly to the challenge. If the player so challenged answers incorrectly, then that same player has to transfer a coin to the player making the challenge.

Any math problem card 12 that is not answered correctly by any player is returned to the bottom of the cards occupying that particular receiving area 20.

From this point the game is continued to be played with one player after another taking his or her turn in rolling the dice 18 and advancing the respective token 16 around the game board 10.

Once the game board 10 is clear of all math problem cards 12, then the player with the most coins is declared the winner.

It should be emphasized to the players that when a respective answer flap 28 is open that each player should try to remember the multiplication problem or problems that underlie that answer flap. This could be beneficial during the course of the game when a player is presented a certain math problem from the various math problem cards 12 that form a part of the present game and game board.

From the foregoing discussion, it is appreciated that the game and game board apparatus of the present invention presents a very effective and efficient manner of teaching children basic math fundamentals. The game is interesting, exciting and challenging. Simply by attempting to accomplish the ultimate goals and objectives of the game encourages the individuals playing to master the fundamental math problems presented because in order to be successful in playing the game requires that such math problems be mastered.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A math matching game and game board for teaching children certain math fundamentals such as multiplication, addition, subtraction, etc., said game and game board comprising:

A. a set of math problem cards with each card including a math problem thereon;

B. a set of playing tokens and chance means forming a part of said game with said chance means serving to establish movement values for the respective tokens during the course of said game;

C. reward means forming a part of said game for rewarding individual players for correct answers given during the course of the game;

D. a game board having a series of math problem card receiving areas formed on said board, one after another, each math problem card receiving area functioning to receive one or more of said math problem cards and to define one token movement increment on said board such that in the course of playing said game the respective tokens are moved and advanced from one receiving area to another;

E. a matching answer area formed on said game board and including a series of answer flaps with each answer flap including a problem answer thereon and wherein each answer flap is movably disposed with respect to said game board for being moved from a normally closed position to an open position;

F. said matching answer area further including a math problem matching area that includes a series of math problems that match and correspond with the respective math problems formed on said math problem cards;

G. said answer flaps being disposed over said matching math problems with each flap including a correct answer for the problem or problems it overlies in said closed position; and H. wherein in said closed position said answer flaps hide the underlying problem or problems and in the open position the underlying problem or problems are visibly exposed such that in the course of playing the present game each respective token will be advanced about said game board and over the respective math problem card receiving areas and upon landing on a certain receiving area a selected player is given the opportunity to state the correct answer to that particular problem found on the uppermost card of that receiving area and thereafter the stated answer is checked for accuracy by lifting the respective answer flap having that answer thereon to see if the underlying problem or problems match with the problem presented and found on the math problem card presented that player.

2. The math matching game of claim 1 wherein said math problem card receiving areas are formed about a closed loop on said game board and wherein the matching answer area is formed on said game board interiorly of said loop of math problem card receiving areas.

3. The math matching game of claim 2 wherein each math problem card receiving area includes a surrounding side wall that defines an area for receiving one or more math problem cards and wherein the surrounding side wall confines the respective math problem cards within said receiving area.

4. The math matching game of claim 3 wherein said game board is rectangular and wherein said receiving areas are formed about the periphery of said game board with said matching answer area formed interiorly thereof.

5. The math matching game of claim 4 wherein said surrounding wall of said receiving areas include an innermost wall and wherein respective innermost walls of said receiving areas are joined together to form an inner boundary wall and wherein said matching answer area is disposed interiorly of said inner boundary wall.

6. The math matching game of claim 5 wherein said matching answer area includes:

A. a problem area having problems formed thereon in spaced apart relationship that match certain problems on said math problem cards;

B. an open frame structure disposed over said problem area and structured such that respective problems of said problem area are exposed through said open frame structure; and C. wherein said answer flaps are pivotably mounted to said open frame structure and movable thereon between said open and closed positions.

7. The math matching game of claim 6 wherein each answer flap is provided with a lifting tab that extends from a portion thereof opposite the area where said answer flap is pivotably mounted to said open frame structure.

8. The math matching game of claim 7 wherein the surrounding wall of each receiving area includes an outer wall that is provided with a thumb indention formed therein in order to facilitate the removal of respective math problem cards from the respective receiving areas.

9. The math matching game of claim 8 wherein said reward means of said game includes a series of coins that are administered through a game bank during the course of the present game.

10. The math matching game of claim 1 wherein said matching area includes:

A. a problem area having problems formed thereon in spaced apart relationship that match certain problems on said math problem cards;

B. an open frame structure disposed over said problem area and structured such that respective problems of said problem area are exposed through said open frame structure; and C. wherein said answer flaps are pivotably mounted to said open frame structure and movable thereon between said open and closed positions.

11. A math matching game and game board for teaching children certain math fundamentals such as multiplication, addition, subtraction, etc., said game and game board comprising:

A. a set of math problem cards with each card including a math problem thereon;

B. a set of playing tokens and dice means forming a part of said game with said dice means serving to establish movement values for the respective tokens during the course of said game;

C. a series of coins forming a part of said game for rewarding individual players for correct answers given during the course of the game;

D. a game board having a series of math problem card receiving areas formed in a closed loop fashion completely around the periphery of the board, one after another, each math problem card receiving area functioning to receive one or more of said math problem cards and to define one token movement increment on said board such that in the course of playing said game the respective tokens are moved and advanced from one receiving area to another;

E. a matching answer area formed interiorly of the loop of math problem card receiving areas on said game board and including a series of answer flaps with each answer flap including a problem answer thereon and wherein each answer flap is movably disposed with respect to said game board for being moved from a normally closed position to an open position;

F. said matching answer area further including a math problem matching area that includes a series of math problems that match and correspond with the respective math problems formed on said math problem cards;

G. an open frame structure disposed over said math problem matching area and effectively dividing the same into areas such that the math problems therein are visible through the open frame structure;

H. said answer flaps being disposed over said matching math problems and pivotably mounted to said open frame structure for movement between said open and closed positions, each flap including thereon a correct answer for the problem or problems it overlies in said closed position; and I. wherein in said closed position said answer flaps hide the underlying problem or problems and in the open position the underlying problem or problems are visibly exposed such that in the course of playing the present game each respective token will be advanced about said game board and over the respective math problem card receiving areas and upon landing on a certain receiving area a selected player is given the opportunity to state the correct answer to that particular problem found on the uppermost card of that receiving area and thereafter the stated answer is checked for accuracy by lifting the respective answer flap having that answer thereon to see if the underlying problem or problems match with the problem presented and found on the math problem card presented that player.

* * * * *